United States Patent [19]

Preuss et al.

[11] Patent Number: 4,562,419

[45] Date of Patent: Dec. 31, 1985

[54] ELECTRODYNAMICALLY OPENING CONTACT SYSTEM

[75] Inventors: Bernhard Preuss; Karl-Heinz Manthe, both of Berlin, Fed. Rep. of Germany

[73] Assignee: Siemens Aktiengesellschaft, Munich and Berlin, Fed. Rep. of Germany

[21] Appl. No.: 684,477

[22] Filed: Dec. 21, 1984

[30] Foreign Application Priority Data

Dec. 22, 1983 [DE] Fed. Rep. of Germany ..... 3347120

[51] Int. Cl.[4] ..... H01H 77/10

[52] U.S. Cl. ..... 335/195; 200/147 R

[58] Field of Search ..... 335/195, 16, 147; 200/147 R

[56] References Cited

FOREIGN PATENT DOCUMENTS

| | | |
|---|---|---|
| 1079176 | 7/1958 | Fed. Rep. of Germany . |
| 492295 | 7/1970 | Fed. Rep. of Germany . |
| 3208009 | 9/1983 | Fed. Rep. of Germany . |
| 1232636 | 10/1960 | France . |
| 1056152 | 1/1967 | Japan . |

*Primary Examiner*—Harold Broome

*Attorney, Agent, or Firm*—F. W. Powers; J. L. James

[57] ABSTRACT

An electrodynamically opening contact system including a fixed and a movable contact element. The movable contact is biased by a prestressed spring arrangement which is pivotally mounted at one end while at its other end slidably engages the movable contact element such that an overcenter or toggle action is effected.

8 Claims, 5 Drawing Figures

ELECTRODYNAMICALLY OPENING CONTACT SYSTEM

BACKGROUND OF THE INVENTION

This present invention relates to an electrodynamically opening contact system having fixed and a movable contact element. More specifically, the invention comprehends a contact set including a spring means which biases the contacts in both an open and a closed position.

An electrodynamically opening contact system according to the prior art, such as that disclosed in German Pat. No. 1,079,176 incorporates a spring arrangement with two parallel mounted, prestressed tension springs. The springs are both mounted on one end, and at the other end hooked around a pin which traverses a rotating contact element. In the closed contact position the two tension springs generate a contact force on the rotating contact element. As soon as excess current flows through the closed contacts, the rotating contact is thrown away from the fixed contact element by means of an electrodynamic force which acts against the contact force produced by the spring arrangment. At a preset opening angle between the fixed and the rotating contact element the direction of the torque exerted by the spring arrangment on the rotating contact reverses, so that the further opening of the contact is accelerated by the spring arrangement.

It is accordingly an object of this invention to provide an improved electrodynamically opening contact system which in its closed position demonstrates a relatively high contact force but opens with great rapidity and reliability when excess current arises.

SUMMARY OF THE INVENTION

Briefly stated, in accordance with one aspect of the invention the foregoing objects are achieved by providing the movable contact element of a contact system with a guide running transverse to its axis of rotation, and a spring arrangement aligned so that in the closed contact position the line of action of the spring runs approximately at a right angle to the guide which the opposing end of the spring is free to move along the guide.

In one embodiment of the invention, one end of the spring is coupled to a roller which runs along the guide. This ensures that during the contact opening spring arrangement can move with almost no friction along the guide of the movable contact element so that the opening procedure occurs with great speed and reliability.

The guide incorporates two stops for the end positions of the movable end of the spring. These stops assure that during both opening and closing the movable end of the spring arrangement is moved against the appropriate stop, so that after completing the opening or closing cycle the movable contact cannot execute any oscillating motions. In this way the design prevents the occurrence of rebounding effects.

In one presently-preferred embodiment of a contact system constructed in accordance with this invention, the guide is formed by a cutout in the movable contact element, with the ends of the cutout forming the end stops of the guide.

A particularly compact design of the contact system in accordance with the invention can be realized by having the spring arrangement consist of two tension springs which are mounted on both sides of the rotating contact element.

BRIEF DESCRIPTION OF THE DRAWINGS

While the specification concludes with claims particulary pointing out and distinctly claiming the subject matter which is regarded as the invention, it is believed that the invention will be better understood from the following description of the preferred embodiment taken in conjunction with the accompanying drawings in which:

DESCRIPTION OF A PREFERRED EMBODIMENT

Figure 1:
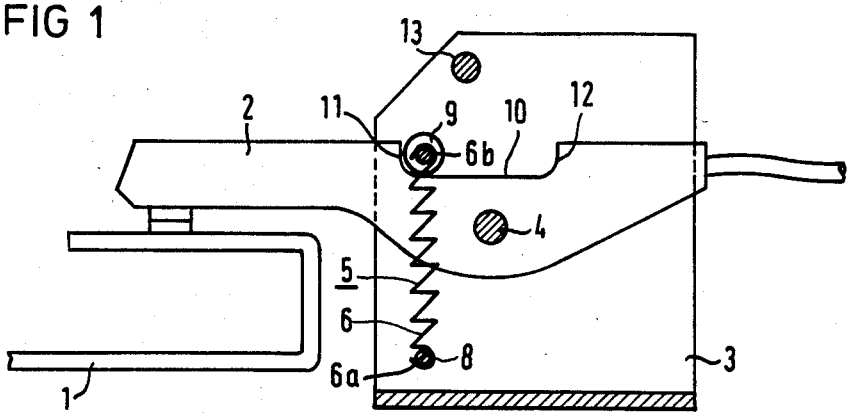
FIG. 1 is a side view of a design type of a contact system constructed in accordance with the invention and shown in the closed contact position.
Figure 2:
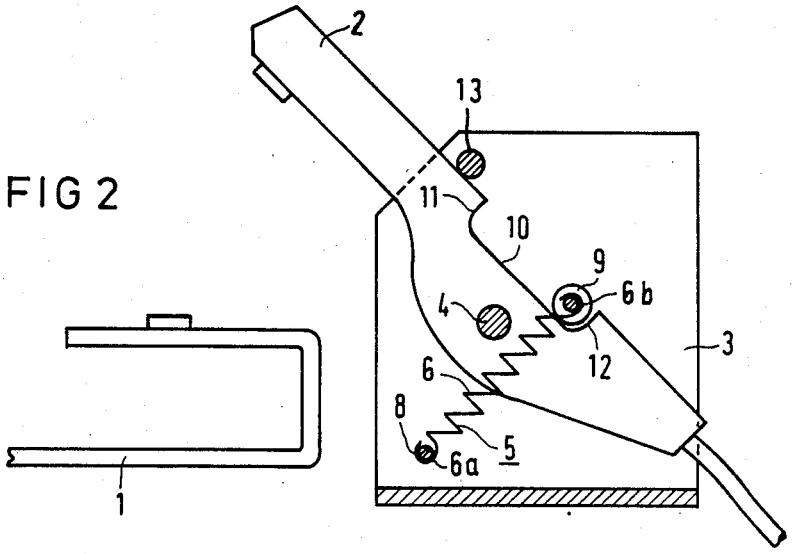
FIG. 2 shows a contact system in accordance with FIG. 1 in the open contact position.
Figure 3:
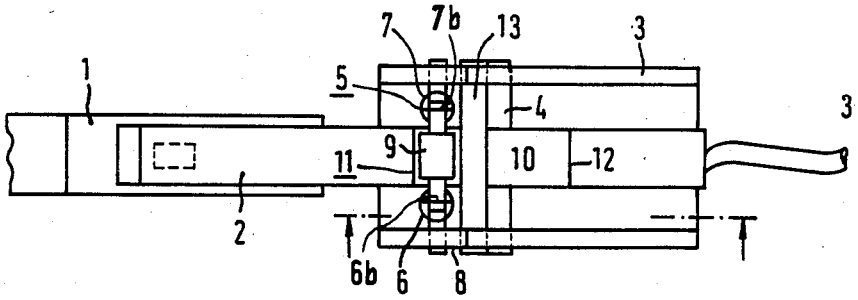
FIG. 3 a plan view on a contact system in accordance with FIG. 1.

The contact system shown in FIGS. 1 through 3 includes a U-shaped, offset fixed contact element 1 and a movable contact element 2 which is mounted in a housing 3 by a rotatable axle 4. The contact system further includes a spring arrangement 5 comprising two prestressed tension springs, one of which is visible at 6. The springs are mounted parallel to each other on both sides of the rotating contact element 2; the other spring, which can be seen in FIG. 3, is designated 7. The two tension springs are always firmly hooked at their lower ends 6*a* to a pin which extends transversely through housing 3. On their upper ends 6*b* and 7*b* the two springs engage the axle of a roller 9 which runs along a guide 10 of contact element 2, transverse to its axis of rotation. The guide 10 is formed by a cutout in the movable contact element 2 and the ends of the cutout form two stops 11 and 12 which define the end positions of the free ends 6*b*, 7*b* of springs 6 and 7 respectively.

In the closed contact position roller 9 is positioned along guide 10 at end stop 11 so that contact 2 is pressed against fixed contact element 1 at a predetermined contact pressure. Thereby movable contact element 2 and one arm of the U-shaped support of contact element 1 are positioned parallel to each other and form a current loop. As soon as the current exceeds a preset value in this current loop the movable contact element 2 is subjected to electrodynamic forces which oppose the contact pressure of the spring arrangement 5, the repel contact element 2 from fixed contact element 1. Roller 9 then moves along the guide 10 from its position at stop 11 in the direction of the stop 12. The position of roller 9 as a function of the opening angle between the fixed and movable contact elements is influenced by the fact that spring arrangement 5 is continuously trying to achieve the lowest possible spring force. Accordingly, the line of action of the spring force generated by the spring arrangement 5 is always perpendicular to the direction of motion of roller 9 along guide 10.

At some predetermined opening angle between the contact elements 1 and 2 the line of action of the spring force moves through the axis of rotation of contact element 2 so that the torque exerted by the spring arrangement 5 on the rotating contact element 2 reverses its direction. Spring arrangement 5 then effects a further opening of the contacts due to its spring force until the movable contact abuts stop device 13.

When contact elements 1 and 2 attain the position in FIG. 2 the roller 9 is located at the second stop 12 of guide 10 whereby the spring arrangement 5 exerts a torque on the movable contact element 2 which keeps the contact in the open position. When the rotating contact element is reset into the position shown in FIG. 1 the roller 9 moves back along guide 10 to its initial position at stop 11.

Figure 4:
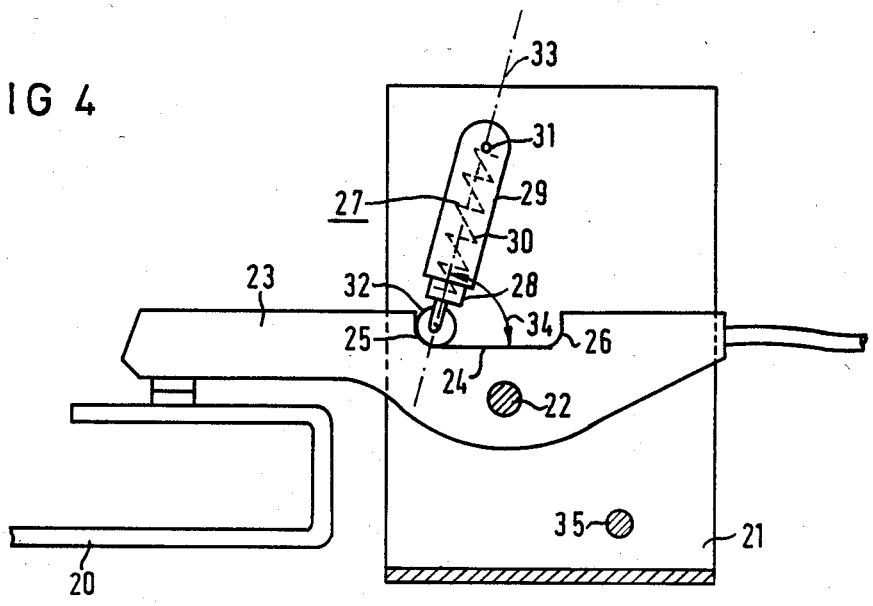
FIG. 4 is a side view of an alternate version of the contact system shown in FIG. 1.
Figure 5:
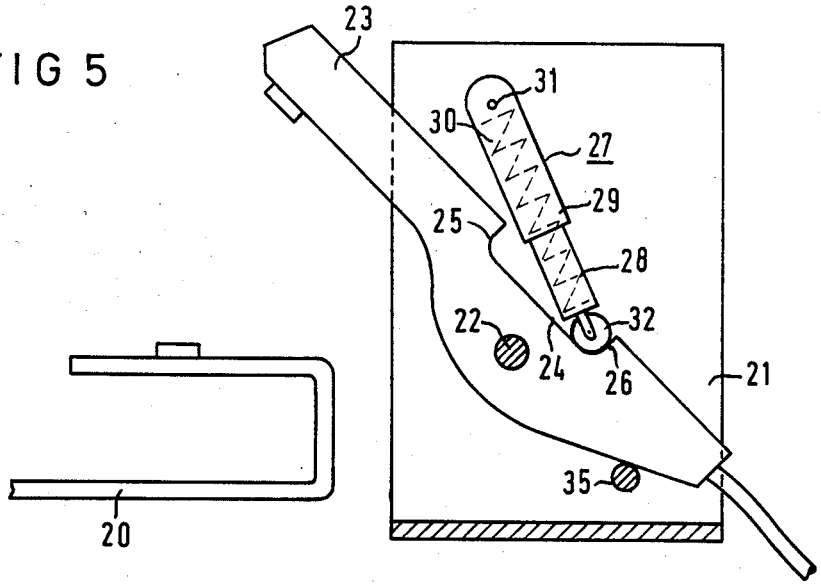
FIG. 5 illustrates the contact system of FIG. 4 in the open contact position.

In the embodiment shown at FIGS. 4 and 5, the contact system operates in a similwr manner to that previously described. A fixed mounted contact element 20 is provided along with a contact element 23 which pivots around a rotating axle 22 disposed in a housing 21, or in a selector shaft. The movable contact element 23 contains a cutout whose edge forms a guide 24 and whose ends define stops 25 and 26 for guide 24. The contact system shown further shows a prestressed spring arrangement 27 comprising two casings 28 and 29 which telescope together and within which a pressure spring 30 is disposed. The spring arrangement 27 is pivotally mounted at one end by a pin 31 which is fixed in housing 21. The other end of the spring arrangement engages a roller 32 which runs transverse to axle 22 along the guide 24 of the movable contact element.

In the closed contact position roller 32 is positioned at the first end stop 25 whereby the line of force 33 of the spring arrangement 27 and the guide 24 define an angle 34 which is slightly smaller than 90 degrees. The roller 32 thereby transmits the force of the spring arrangement 24 to the movable contact element 23 and urges the latter with a predetermined contact pressure against the fixed contact element 20. When excess current flows, the movable contact element 23 is forced away from the fixed mounted contact element 20 by the resulting electrodynamic forces as described above. As a result, the angle between the direction of the force generated by the spring arrangement 27 and the guide 24 is increased. As soon as this angle exceeds 90 degrees the pressure spring 30 of the spring arrangement 27 begins to expand so that roller 32 is moved along guide 24 until it meets stop 26. As roller 32 reaches stop 26, the spring force generated by the spring arrangement 27 is again transmitted over roller 22 on to contact element 23. The torque exerted on the movable contact element 23, determined by the position of roller 32 at stop 26, brings about a further opening of the contact until it encounters stop 35.

It will now be appreciated that a major advantage of a contact system constructed in accordance with the present invention is that in the closed contact position, due to the approximately vertical direction of the spring force on the guide of the moveable contact element, the force component of the spring arrangement and thus of the contact force used to generate the contact pressure is particularly great. A further advantage of the described contact system is due to the mobile mounting of the spring arrangment on the rotating contact element since in case of excess current the spring arrangment accelerates the further opening of the contact following only a slight opening of the contact due to electrodynamic forces. Specifically, as soon as excess current flows through the closed contact and brings about a separation of the movable contact element from the fixed contact element due to the impact of electrodynamic forces, the other end of the spring arrangement is moved into new positions along the guide depending upon the opening angle between the movable and the fixed mounted contact element so that in those positions the force generated by the spring arrangement always assumes the lowest possible level. Accordingly, even at a small opening angle a positioning of the spring arrangement is attained whereby the torque acting on the rotating contact element reverses its direction and thereby brings about further opening of the contact.

It will also be appreciated that the guide can be so contoured that the torque exerted by the spring arrangement on the mobile contact element assumes optimal values in terms of having a higher opening velocity during the contact opening and reflecting the opening angle.

As will be evident from the foregoing description, certain aspects of the invention are not limited to the particular details of the examples illustrated, and it is therefore contemplated that other modifications or applications will occur to those skilled in the art.

It is accordingly intended that the claims shall cover all such modifications and applications as do not depart from the true spirit and scope of the invention.

What is claimed as new and desired to be secured by Letters Patent of the United States is:

1. An electrodynamically opening contact system comprising a fixed contact element;

a movable contact element;

means for pivotally supporting said movable contact element;

said fixed and movable contact elements being arranged with respect to one another that the electromagnetic forces arising about said contact elements as a result of current passing therethrough causes said contact elements to separate;

guide means formed in said movable contact element and extending generally transversely to the pivot axis thereof;

spring means having a first, pivotally mounted end and a second, free end, said second end bearing upon said guide means;

said spring means being so disposed with respect to said guide means that in a closed contact position the line of action of said spring means extends at substantially right angles to said guide and to one side of the pivot axis and in an open position said line of action extends to the other side of said pivot axis.

2. A contact system according to claim 1, further including a roller mounted at the free end of said spring means.

3. A contact system according to claim 2, further including first and second stops disposed at opposite ends of said guide means for limiting the travel of the free end of said spring means.

4. A contact system according to claim 3, wherein said guide and said stops are formed by a cutout in said movable contact element.

5. A contact system according to claim 1, wherein said spring means comprises a pair of tension springs disposed at opposite sides of said movable contact element.

6. A contact system according to claim 1, further including first and second stops disposed at opposite ends of said guide means for limiting the travel of the free end of said spring means.

7. A contact system according to claim 6, wherein said guide and said stops are formed by a cutout in said movable contact element.

8. A contact system according to claim 2, wherein said spring means comprises a pair of tension springs disposed at opposite sides of said movable contact element.

* * * * *

UNITED STATES PATENT AND TRADEMARK OFFICE

CERTIFICATE OF CORRECTION

PATENT NO. : 4,562,419

DATED : December 31, 1985

INVENTOR(S) : Bernhard Preuss and Karl-Heinz Manthe

It is certified that error appears in the above-identified patent and that said Letters Patent are hereby corrected as shown below:

On the title page, under the heading "FOREIGN PATENT DOCUMENTS" regarding Foreign Document No. 492,295, delete "Fed. Rep. of Germany" and substitute --Switzerland--; regarding Foreign Patent Document No. 1,056,152, please delete "Japan" and substitute --Great Britain--.

Column 3 line 12, delete "similwr" and substitute --similar--.

Signed and Sealed this

*Twenty-second* Day of *April 1986*

[SEAL]

*Attest:*

DONALD J. QUIGG

*Attesting Officer*

*Commissioner of Patents and Trademarks*